United States Patent [19]

Klein

[11] Patent Number: 4,939,823

[45] Date of Patent: Jul. 10, 1990

[54] SOCK PAIRER AND HOLDER

[76] Inventor: Milton L. Klein, 30 E. 208th St., Bronx, N.Y. 10467

[21] Appl. No.: 423,017

[22] Filed: Oct. 18, 1989

[51] Int. Cl.[5] ..... A41F 1/00

[52] U.S. Cl. ..... 24/590; 24/694

[58] Field of Search ..... 24/590, 555, 453, 693, 24/662, 324, 599, 103, 108, DIG. 11, 694; 2/DIG. 6; 411/386, 387

[56] References Cited

U.S. PATENT DOCUMENTS

| | | | |
|---|---|---|---|
| 131,879 | 10/1872 | Jarboe | 24/590 |
| 1,410,770 | 3/1922 | Silverman et al. | 24/590 |
| 1,738,371 | 12/1929 | Jenckes | 24/590 |
| 1,795,674 | 3/1931 | Potter | 24/590 |
| 1,873,699 | 8/1932 | Danenberg | 24/590 |
| 1,936,378 | 11/1933 | Carr | 24/590 |
| 2,028,740 | 1/1936 | Devine | 24/103 |
| 4,246,679 | 1/1981 | Monett | 24/590 |
| 4,682,389 | 7/1987 | Callender | 24/549 |

*Primary Examiner*—Victor N. Sakran

[57] ABSTRACT

An openable and refastenable loop having combination closure and insertion means comprising cooperating male and female threaded sections, each section being joined to the loop by swivel means permitting axial rotation of each threaded section independent of the loop to which it is attached. Loop ports are provided in each sock to be paired, and the threaded sections are sufficiently long to permit insertion of the loop through the ports.

1 Claim, 2 Drawing Sheets

SOCK PAIRER AND HOLDER

BACKGROUND OF THE INVENTION

Pairs of socks often become separated when placed with a wash load of other clothes. When one of a pair is lost, the remaining sock is generally not usable without its match. Time spent in trying to sort through multiple socks to find matching pairs is wasteful and frustrating.

Prior methods of handling such problems include tying the socks of a pair together. This is not altogether satisfactory is that it simply replaces the time spent in finding matching socks with the time spent in knotting then washing and unknotting them after washing. Loose knotting may open up during washing or drying while tight knotting tends to destroy the sock's appearance and resists unknotting.

SUMMARY OF THE INVENTION

The present invention provides a simple means for holding socks of a pair together during washing while affording other functions and advantages. The means provides a way of hanging the sock pair on a hook or around a hanger, so that storage, selection and retrieval of a pair of socks is no longer a matter of rummaging through a drawer full of socks, but is as convenient as selecting a tie from a tie rack.

The present invention provides means for a hanging sales display for socks which is eye-catching and which provides a unique value-added feature to conventional sock selling. The present invention additionally provides a new medium for advertising, whether the socks themselves, advertising of related products or tie-in advertising, thereby providing substantial merchandising advantages.

In summary, the present invention provides a wash-resistant loop with closure and insertion means combined in a mechanism which has cooperating male and female threaded sections adapted to cooperatively join to close the loop. The threaded sections are sized so as to be easily inserted through ports provided for the purpose in each sock of a pair so that the loop may be pushed or pulled through both ports. The threaded sections are then joined to close the loop. Means are provided to permit axial rotation of the threaded members independent of the loop, that is, the threaded members may be rotated into or out of threaded engagement without also rotating and possibly twisting or breaking the loop.

DESCRIPTION OF A PREFERRED EMBODIMENT

Figure 1:
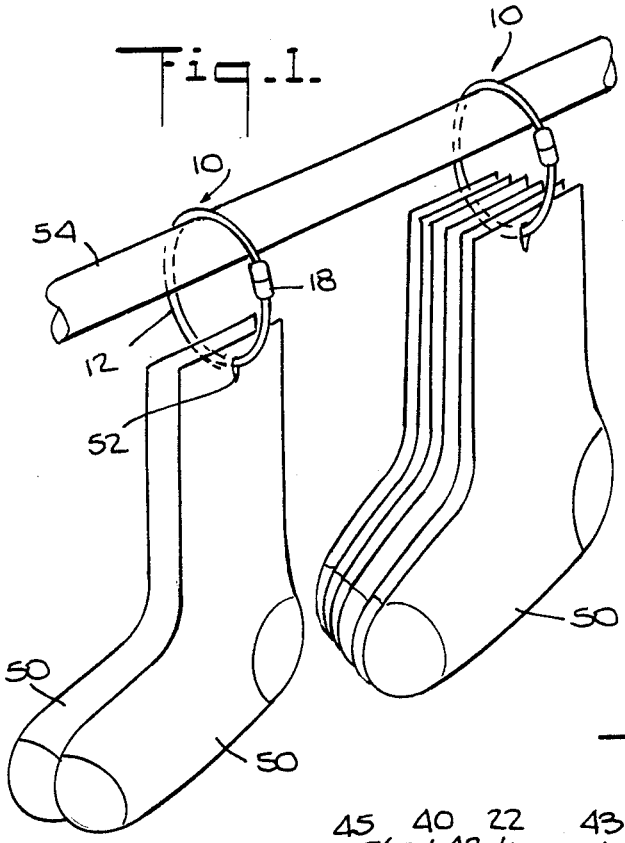
FIG. 1 is a perspective view of two sock pairers of the present invention shown hanging from a bar with socks attached.
Figure 3:
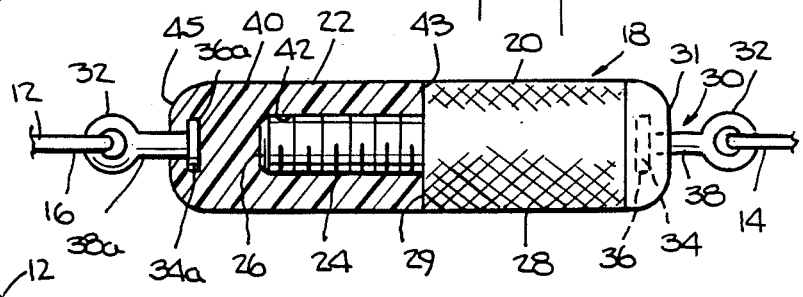
FIG. 3 is a partly cross-sectional view of the closed clasp of the present invention showing ring means for attaching the loop invention to the clasp thereof.
Figure 2:
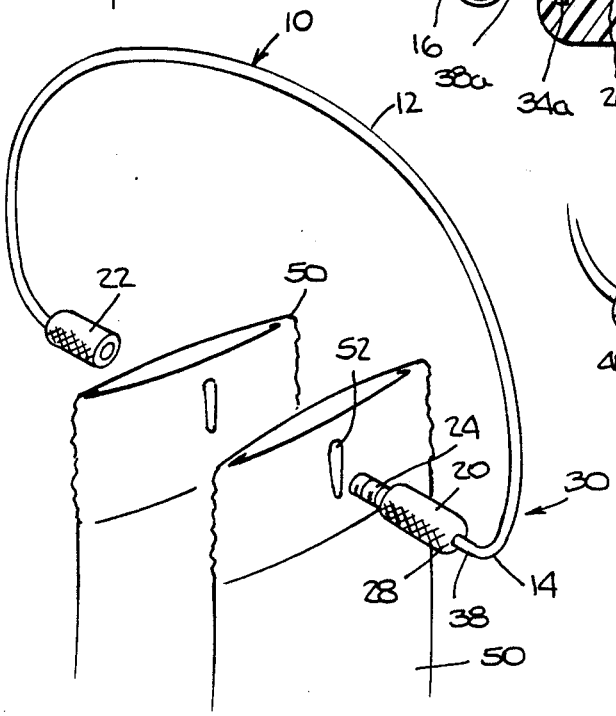
FIG. 2 a view of an open sock pairer ready to be inserted into pre-formed holes in socks of a pair.

With reference to the drawing, the sock pairer and holder 10 of the present invention comprises a loop 12 having two ends 14 and 16 to which are fastened clasp means 18. In the preferred embodiment, clasp means 18 comprises cooperating male and female threaded sections 20 and 22 to which loop ends 14 and 16 are connected, respectively.

Male threaded section 20 comprises a male threaded screw 24 which has a leading edge 26 which is smoothly rounded or optionally pointed to provide ease of insertion as will hereinafter be described. Male threaded section 20 further comprises a male shoulder portion 28 joined to threaded screw 24 at one face 29 and having loop securing means 30 at its end opposite face 31.

In the preferred embodiment, loop securing means 30 comprises a ring 32 swivelly or rotatably secured to shoulder portion 28 of male threaded section 20 by means of an enlarged bead or head 34 rotatably held in a socket recess 36 provided for the purpose in male shoulder portion 28 and joined by shaft 38 to ring 32. First end of 14 of loop 12 is secured to or through ring 32 and, by reason of the bead 34 and socket 36 arrangement just described, male threaded section 20 may rotate axially independently of loop 12.

Female threaded section 22 comprises female shoulder portion 40 having a threaded recess 42 adapted to threadedly receive screw 24, a face 43 and loop securing means **30*a* corresponding to loop securing means 30 at opposite face 45 to secure second end 16 of loop 12. Loop securing means 30*a* also has corresponding bead 34*a*, shaft 38*a* and recess 36*a* whereby female threaded section 22 may axially rotate relative to and independent of loop 12**.

The external diameter and surface configuration of male shoulder portion 28 is the same as that of female shoulder portion 40 such that, when threaded together until face 29 meets face 43, the outside of male threaded section 20 and of female threaded section 22 present an unbroken snag-resistant uniform surface. Such surface preferably is ribbed or otherwise texturized so as to be non-slip.

Each sock 50 of a pair is provided with at least one port or hole 52, similar to a finished buttonhole, through which loop 12 may be drawn. Leading edge 26 of male threaded section 20 is adapted, by reason of being rounded or pointed, to smooth insertion into hole 52. Male and female threaded sections 20 and 22 are then threadedly joined by rotation until tight. Loop 12 does not rotate or tangle due to the swivel connections at its ends to the threaded sections.

The pair of socks thus looped together are not separable during washing, and may be hung to dry, or for closet storage such as closet rod or bar 54, by means of the loop.

The time-saving convenience of having inseparable, hangable socks by means of the present invention provides a commercially useful product when sold by itself or, when packaged with socks, provides added value to the sock product. The sock pairer and hanger of the present invention is adapted to be a premium item, to allow new socks to be hung for sales display or to accommodate hang tags or advertising material. A plurality of such hangers can be packaged together with a series of closet hooks so that multiple pairs of socks can be stored with the neatness and ease of selection as ties on a tie rack.

It has been found that the present invention can be used with sheer hose, if holes 52 are placed at the reinforced tops thereof. The same is true for pantyhose, although the invention is not used for keeping track of a pair of pantyhose since they are one unit. Multiple pantyhose can be looped together for point of sale display, closet hanging or ease of retrieval from a washing machine.

It is preferred that loop 12 be made of a flexible wash-resistant material such as nylon thread. It is also preferred that the axial length of clasp means 18 be approximately 1¼" when the male and female sections are joined, that the diameter thereof be approximately 3/16" and that the axial length of female section 22, and of male section 20 exclusive of threaded screw 24, be approximately ¾".

Figure 4:
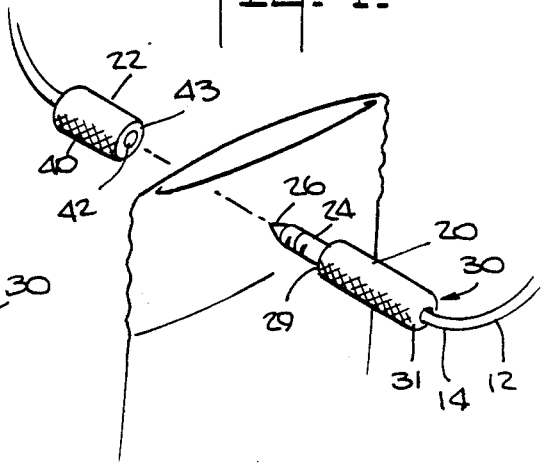
FIG. 4 is a view of a modified open sock pairer having a pointed leading edge ready to be inserted into a sock which does not have hole.
Figure 5:
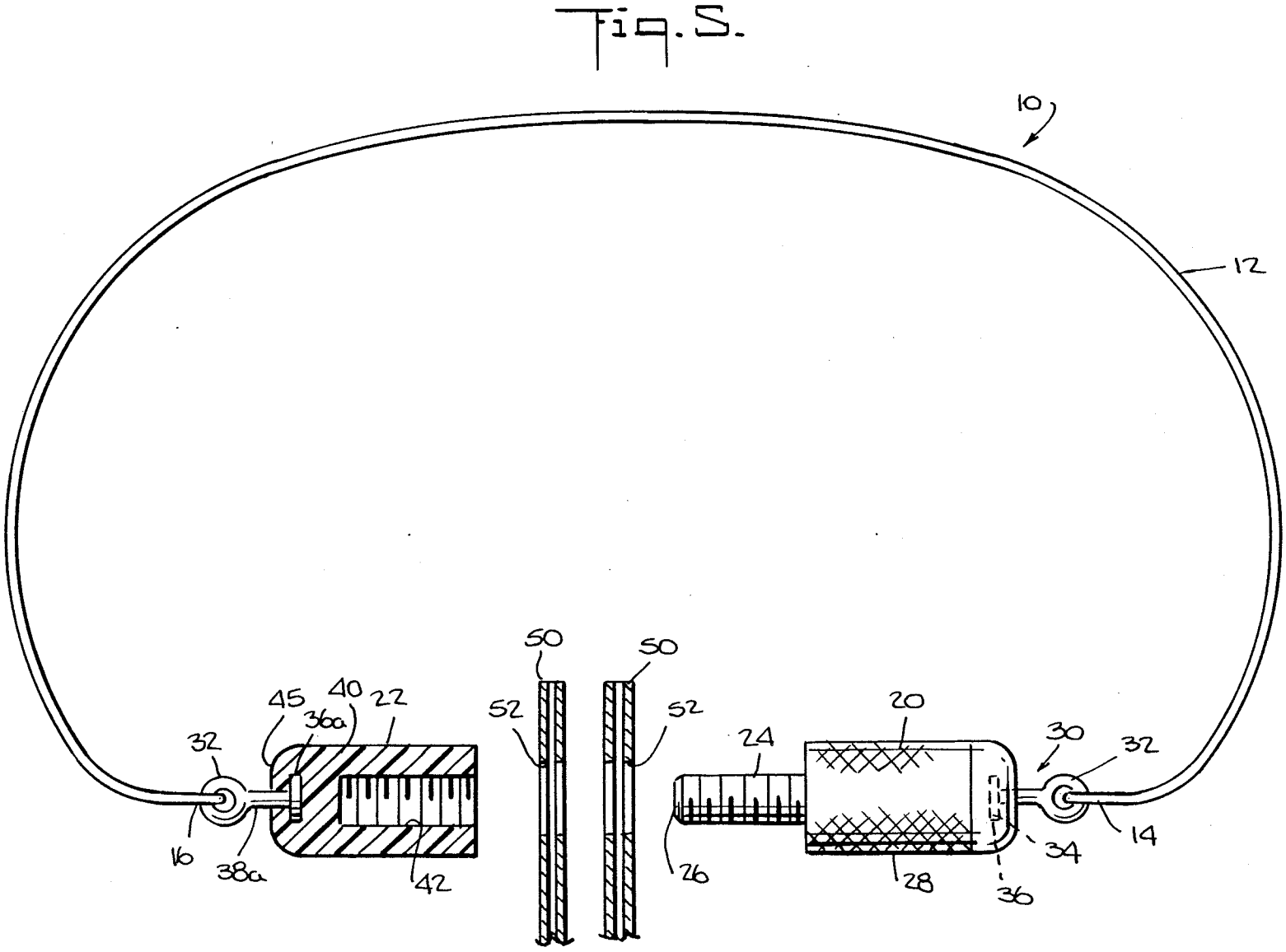
FIG. 5 is a partly cross-sectional view similar to that of FIG. 3, but showing the clasp opened, a full loop, and a fragmentary pair of socks.

As an aftermarket product, that is, sold separately to be used to pair previously purchased socks which do not have pre-formed holes 52, leading edge 26 of male threaded screw 24 may be pointed to pierce the elastic portions of socks without ripping or rupturing the material. In such product, shown for example in FIG. 4, the outer surface of male threaded section 20 adjacent loop securing means 30 is tapered or smoothly rounded to permit male threaded section 20 to be pulled out of the pierced socks without ripping or damaging the material. Also in a modified embodiment as shown in FIG. 4, rings 32 may be dispensed with and loop ends 14 and 16 enter the clasp 18 directly.

While the foregoing is illustrative of a preferred and modified embodiment, other embodiments may be had within the scope hereof.

What is claimed is:

1. A sock pairer and holder, comprising (a) loop means, said loop means having two ends, (b) clasp means, said clasp means comprising cooperating male and female threaded sections, (c) loop securing means, said loop securing means connecting the ends of said loop to said male and female threaded sections, (d) said loop securing embodying swivel means whereby said male and female threaded sections are axially rotatable relative to said loop, (e) said loop securing means comprising ring means, said ring means securing the ends of said loop, said ring means being rotatably engaged with said male and female threaded section, (f) said swivel means comprising head means joined to said ring means, said head means rotatably engaging sockets in said male and female threaded sections, (g) said male threaded section comprising a male shoulder portion and a screw portion joined thereto, and said female threaded section comprising a female shoulder portion, the axial length of said male threaded section exclusive of said threaded screw portion being approximately three-quarters of an inch and the axial length of said clasp means when said male threaded section and said female threaded section are joined being approximately one and one-quarter inches, said threaded screw portion being pointed thereby being adapted to pierce the socks.

* * * * *